US006263892B1

(12) United States Patent
Baker

(10) Patent No.: US 6,263,892 B1
(45) Date of Patent: Jul. 24, 2001

(54) SUPPORT ASSEMBLY FOR A CRUTCH USER

(76) Inventor: Steve G. Baker, 743 San Ramon Ave., Sunnyvale, CA (US) 94086

( * ) Notice: Subject to any disclaimer, the term of this patent is extended or adjusted under 35 U.S.C. 154(b) by 0 days.

(21) Appl. No.: 09/302,631

(22) Filed: Apr. 29, 1999

Related U.S. Application Data

(60) Provisional application No. 60/083,438, filed on Apr. 29, 1998.

(51) Int. Cl.[7] ..... A45B 5/00; A61H 3/02

(52) U.S. Cl. ..... 135/66; 297/5

(58) Field of Search ..... 135/66, 68; 280/812; 224/159, 160; 297/118, 129, 5

(56) References Cited

U.S. PATENT DOCUMENTS

| | | | | |
|---|---|---|---|---|
| 768,882 | * | 8/1904 | Morse . | |
| 1,063,846 | | 6/1913 | Winthers . | |
| 1,769,167 | | 7/1930 | Scheihing . | |
| 2,257,831 | * | 10/1941 | Wood . | |
| 2,351,145 | | 6/1944 | Pearson . | |
| 3,451,064 | | 6/1969 | Dolan . | |
| 3,538,512 | | 11/1970 | Dolan . | |
| 3,874,687 | * | 4/1975 | Cadwalader . | |
| 4,065,140 | | 12/1977 | Cadwalader . | |
| 4,245,659 | | 1/1981 | Shofner . | |
| 4,456,284 | * | 6/1984 | Saka | 280/812 |
| 4,786,082 | | 11/1988 | Sweitlik . | |
| 4,793,370 | | 12/1988 | Perez . | |
| 5,165,436 | | 11/1992 | Hall . | |
| 5,313,971 | | 5/1994 | Upshaw . | |
| 5,348,035 | | 9/1994 | Porter . | |
| 5,353,824 | * | 10/1994 | Woods et al. | 135/66 |
| 5,664,713 | | 9/1997 | Burgstahler . | |
| 5,673,719 | | 10/1997 | Shofner . | |
| 5,755,644 | | 5/1998 | Breems . | |
| 5,911,234 | * | 6/1999 | Hirst | 135/68 |

FOREIGN PATENT DOCUMENTS

| | | |
|---|---|---|
| 4102498 | 7/1992 | (DE) . |
| 506235 | 5/1920 | (FR) . |
| 112098 | 12/1917 | (GB) . |
| 140171 | 3/1920 | (GB) . |
| 1713582 A1 | 2/1992 | (SU) . |
| 1717135 A1 | 7/1992 | (SU) . |

OTHER PUBLICATIONS

Article Taylor, J A New Saddle–Crutch Aug. 4, 1883, The Medical Record p136.

* cited by examiner

*Primary Examiner*—Robert Canfield
(74) *Attorney, Agent, or Firm*—Carol D. Titus; James J. Leary

(57) ABSTRACT

A support assembly for a crutch user comprising a seat element, an element to suspend the seat from the crutches, and a seat urging means to urge the seat towards the user. The seat urging means may releasably attach the seat to the crutch or to the user. The seat urging means optionally helps stabilize the seat during entry and exit. The seat urging means may disengage at a predetermined position. Alternatively, the seat urging means may release at a predetermined force. The seat urging means may be adjustable for location of pull, or direction of pull, or amount of pull.

A support assembly for a crutch user comprising a seat element, an element to suspend the seat from the crutches, and an element to stabilize the seat for easier entry and exit.

18 Claims, 19 Drawing Sheets

SUPPORT ASSEMBLY FOR A CRUTCH USER

CROSS REFERENCE TO OTHER APPLICATIONS

This application claims the benefit of U.S. Provisional patent application Ser. No. 60/083,438 filed Apr. 29, 1998.

BACKGROUND OF THE INVENTION

1. Technical Field

The present invention relates generally to a support assembly for a crutch user, and more particularly to a seat system for a crutch user that serves to transfer a portion of the support of the body weight from the user's hands, arms, underarm areas and shoulders to the user's buttocks so as to reduce the fatigue, exertion, and damage associated with the use of crutches.

2. Description of the Related Art

The field of the prior art includes several prior attempts to provide a support assembly for a crutch user. For example, British Patent 112,098 by Clifford describes a suspended seat and breeches and pads that pass under the user's "fork" (i.e. crotch). This device is impractical in use, in part due to the difficulty of getting into and out of the device. Attaching to the device is inconvenient and difficult, making it less useful for frequent travel over short distances. Separating oneself from the device is both inconvenient and potentially hazardous. If the user forgets to remove the device and, for example, attempts to sit down in a chair, he may become entangled in the device and crutches and fall.

Also, the publication titled "A New Saddle-Crutch" by Dr. James R. Taylor in The Medical Record (Aug. 4, 1883) shows a small saddle worn under the user's crotch and inside the user's clothing. To separate himself from the crutches, the user unhooks the suspenders from the crutches. Wearing the saddle under clothing is inconvenient, because the user must partially undress to get into or out of the saddle. Wearing the saddle inside the clothing and the suspenders outside the clothing, when not on the crutches, may be uncomfortable (for example when sitting in a chair). Saddle type devices that fit inside the user's crotch may be awkward for discreet use by a person wearing a skirt or dress.

British Patent 140,171 by Dunne describes telescopic crutches with a suspension seat or saddle. The seat connects to and operates a telescoping mechanism built into the special crutches. This device requires special crutches and may not be used with standard crutches. The device contains forked rods and appears to be rigid. This makes the device impractical for compact transportation when not in use.

U.S. Pat. No. 5,348,035 by Porter discloses a harness assembly for a crutch user. The user is strapped or buckled into the harness with a waist belt, leg straps, and optional suspenders. The fastenings are designed to stay fastened until the user manually unfastens them. To sit down in a chair, the user must always remember to first detach either the harness from himself or the harness from the crutches. If the user forgets, he may become entangled, may lose his balance, and may fall and be injured. After remembering to manually detach either the harness from himself or the harness from the crutches, the user must locate all required fasteners and operate them. To get back into the device, the user must manually reconnect all required fasteners in their correct locations. As described above, this is time consuming and inconvenient, and greatly limits the utility of the device for frequent uses. Like saddle type devices that fit inside the user's crotch, harness type devices that fit inside the user's crotch may be awkward for discreet use by a person wearing a skirt or dress.

Thus, what has been needed and heretofore unavailable is a support assembly for a crutch user that is effective, safe, comfortable and convenient to use.

SUMMARY OF THE INVENTION

In accordance with the present invention, applicant provides a support assembly for use with crutches. The seat assembly is designed specifically for minimizing the discomfort, exertion and damage associated with the use of crutches. The invention includes a seat assembly that is suspended from a pair of crutches and at least partially supports the user's body weight and reduces the force on the user's upper body. The invention also includes at least one seat urging means to urge the seat assembly towards the user. An attachment means 144 may releasably attach the seat urging means from the seat assembly to the crutch, to the user's clothing, or to the user. The seat assembly may disengage from the user at a predetermined position and/or the seat assembly may automatically disengage from the user at a predetermined force.

The seat may support the user while the user is walking with the crutches or while the user is stationary. The seat encourages the user to reduce the amount of force applied to the upper body by the crutches, and spreads the burden of supporting the user over a larger region of the body. One advantage of the present invention is that it reduces the risk of injury to the upper body. Several locations in the upper body such as the axillary nerve under the armpit or nerves in the hand may be acutely or chronically damaged by localized pressure caused by the use of standard axillary crutches.

Another advantage of the invention is that it reduces fatigue and repetitive overuse injuries, as a crutch user may not be accustomed to supporting their body weight with the muscles bones and joints of the upper body, which are smaller and weaker than those of the lower body and have not evolved for this purpose. Sitting in the crutch seat may be more convenient than sitting on a chair, which requires the extra work of getting down onto and getting up from the chair.

One object of the present invention is to provide a seat assembly that the user may enter and exit relatively easily, conveniently and safely thus overcoming the limitations of the prior art.

An optional object of the present invention is to urge the seat close to the user to reduce the chance of the seat slipping off the user, while maintaining the advantages of easy entry and exit.

Another optional object of the present invention is to provide a seat system that automatically disengages from the user at a predetermined position.

A further optional object of the present invention is to provide a seat system that automatically disengages from the user at a predetermined force.

Yet another optional object of the present invention is to provide a seat system that may be used with conventional crutches.

Other features and advantages of the present invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
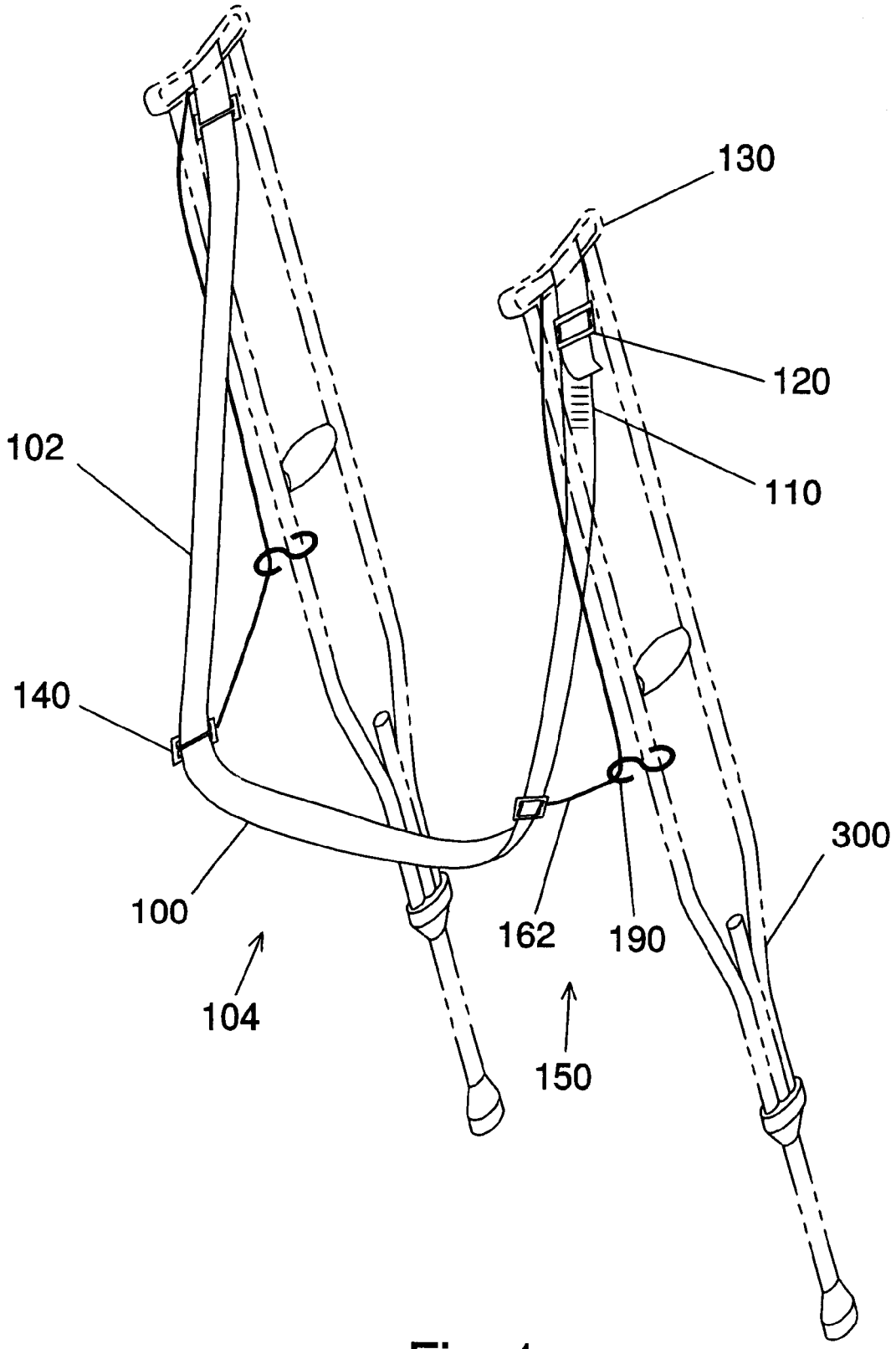
FIG. 1 is a perspective view of the support assembly for a crutch user attached to crutches.
Figure 2:
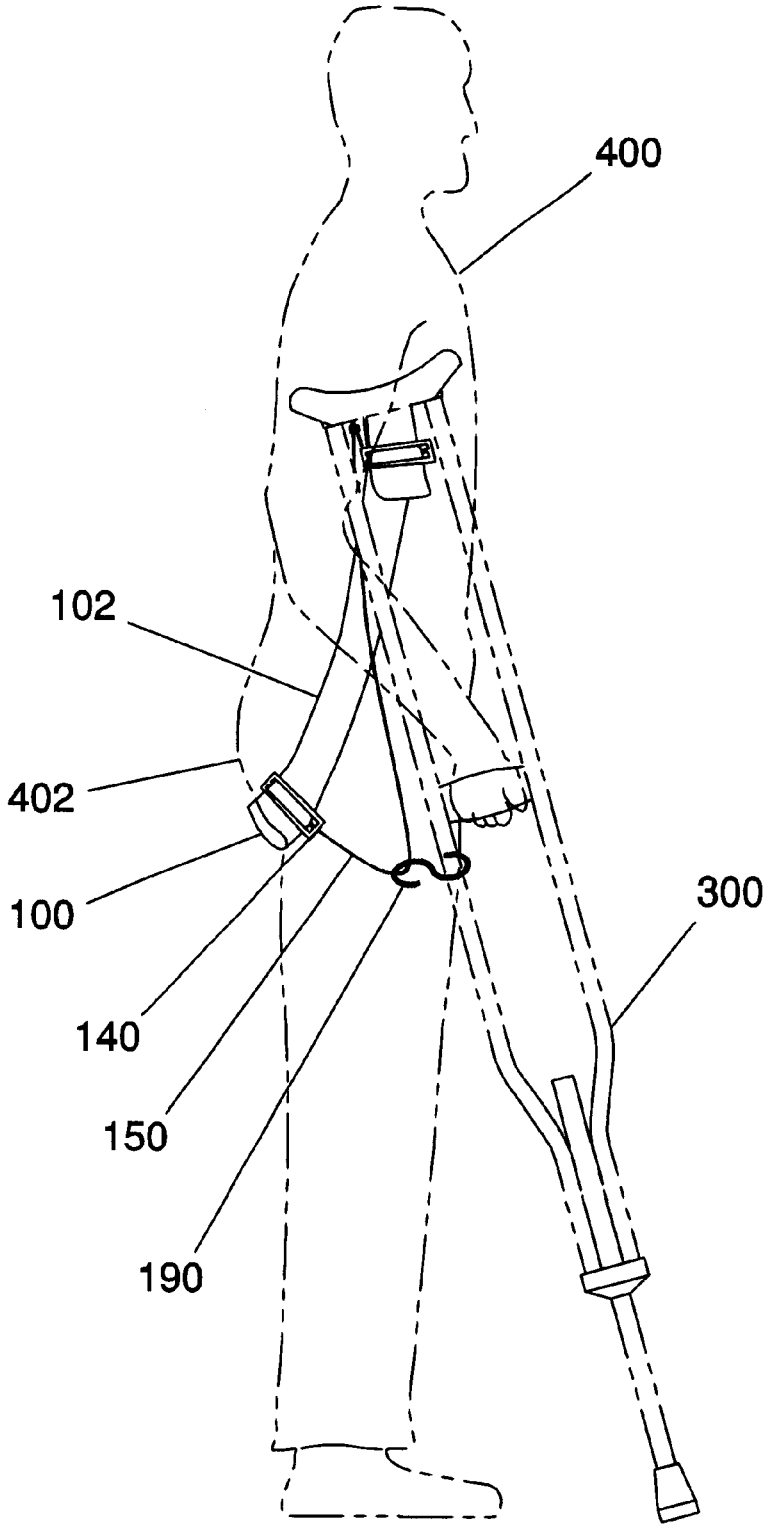
FIG. 2 is a side view of the support assembly, crutches, and a user (shown in phantom lines).

The present invention takes the form of a seat assembly 104 that is suspended from a pair of crutches 300 and a seat urging means 150 for urging the seat towards the user. In FIGS. 1–4B, the seat assembly 104 comprises a seat element 100 with integral suspension elements 102 extending from each side. The suspension elements 102 are attached near or to the axillary support of the crutches 300. The user 400 places their butt 402 and/or at least one leg on the seat element. At least a portion of the user's weight may be transferred to the seat element, from the seat to the suspension element, and from there to the crutches 300. At least one crutch reinforcing element 130 as shown in FIG. 1 may be provided at the point of attachment between the suspension element and the crutch, to spread the force of the suspension element over a wider area of the crutch or to strengthen the crutch. The reduces the chance of the crutch breaking with prolonged use under heavy loads. Examples of material for the seat 100 and suspension element 102 include flexible nylon fabric webbing similar to the used in automotive seat belts (preferably 50 mm wide, but other widths would also function), tubular nylon webbing similar to that used in mountain climbing, leather strap, and a fabric sling.

Figure 23:
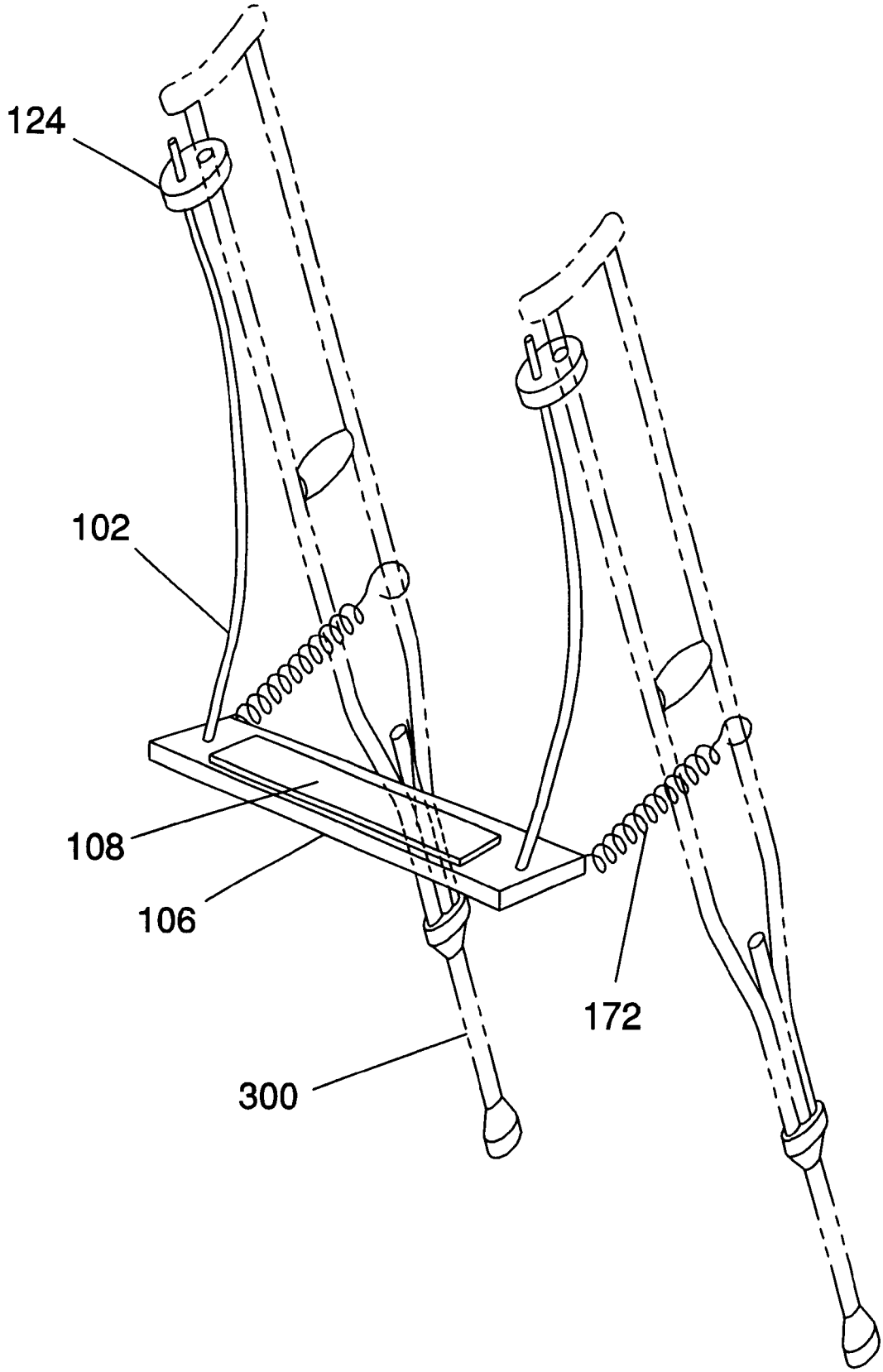
FIG. 23 is a perspective view of the support assembly with a rigid seat, flexibly suspension elements, clamps to attach the suspension elements to crutches, spring seat urging means, and crutches (shown in phantom lines).

The seat is preferably flexible, but may be rigid 106. The seat may have at least one folding section. The seat may be covered with a material to increase friction and reduce slipping, such as Slip-Fix™ coating by Cascade Designs, textured rubber, urethane, silicone, vinyl, latex, or hook fastener material or loop fastener material. The seat may have padding 108 to increase comfort, such as foam rubber, fleece material sheepskin, and terry cloth. (FIG. 23)

Figure 9A:
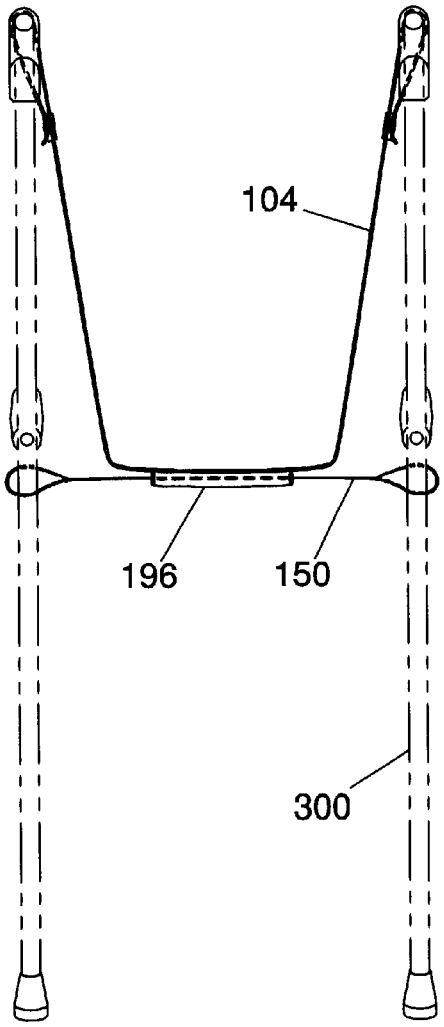
FIG. 9A is a rear view of the support assembly with an elastic cord from one crutch to the other routed through a sleeve on the seat.
Figure 9B:
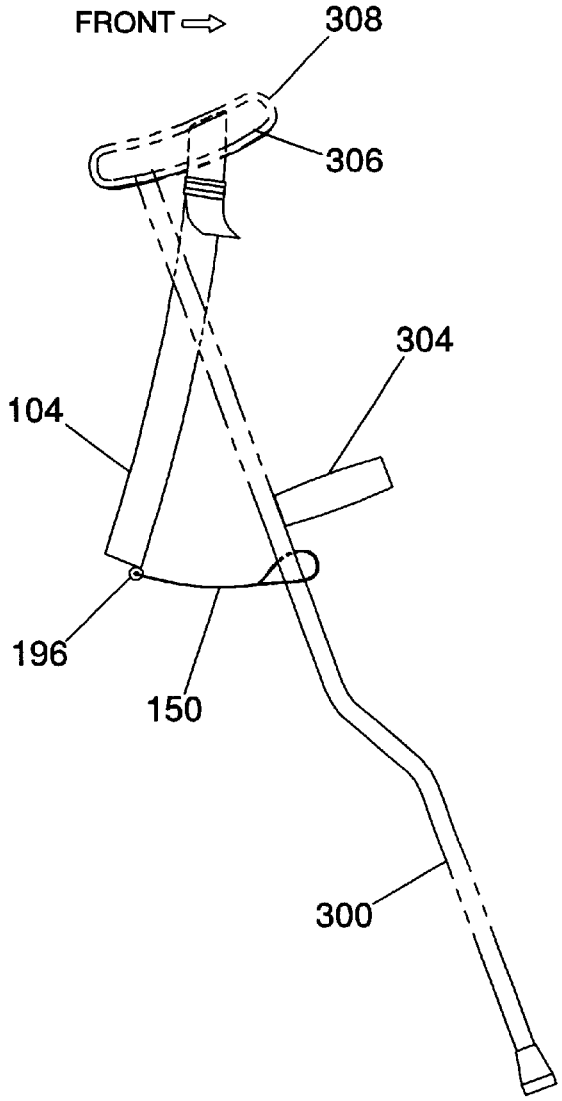
FIG. 9B is a side view of the support assembly with a cord from one crutch to the other of FIG. 9A.

The suspension element may attach anywhere on the crutch, preferably on the upper portion at or near the axillary (i.e. armpit) support 306. Said suspension element may be attached to the crutch by wrapping it around the axillary support and fastening it. Example fasteners include a clip 120 such as a plastic Triglide 2 inch double "D" clip or other plastic or metal clip with slots, a hook and loop fastener (e.g. Velcro™) 122, a buckle, a mechanical joint such as a ball and socket, a clamp 124 (FIG. 23), a screw, a rivet, adhesive or other fastening means. For user comfort, the axillary cushion pad 308 of the crutch may be placed over the suspension element 102 and axillary support 306. When using a crutch having two posts, the suspension element 102 may be connected to the axillary support as discussed above and shown in FIGS. 4A, 4B, 5, 6A, 6B, 6C, 7, 8A, 8B. When using a crutch having one post, such as a Canadian "forearm" crutch, the suspension element 102 may be connected to the axillary support in a similar manner. An example is shown in FIG. 9B; the suspension element 102 is wrapped around the axillary support and a cushion may again be added for comfort.

The position of the seat, for example the seat height and seat width, may be adjusted by lengthening or shortening the suspension element 102 and re-fastening the suspension element 102. The suspension element 102 or seat 100 or crutches 300 may be marked with graduated markings 110 to serve as a reference for adjusting seat position as shown in FIG. 1.

The seat urging means 150 urges the seat 100 close to the user. Without the seat urging means 150, the seat 100 may tend to come out from under the user, especially during times when the user's weight is partially or completely off the seat 100. For example, in one style of crutch walking the user first stands on one foot or both feet and plants both of the crutch tips in front of him or her. Then the user shifts his weight from his feet to the seat as he pivots the crutches 300 about their tips to move his body forward. The user's foot or feet then move in front of the crutch tips. At this point, the user shifts his weight from the seat to his feet and prepares to bring the crutches 300 forward again. While standing, the user's weight on the seat 100 is reduced and the seat 100 may slip from under or behind the user. The seat urging means 150 may also serve to stabilize the seat 100 during entry and exit.

The seat assembly 104 may disengage or release from the user at a predetermined position. For example, the seat assembly 104 may disengage the user if the user's posterior is ahead of the crutches 300 by a predetermined amount such as approximately 40 centimeters, but not disengage if the user's posterior relative to the crutches is within the normal range of crutch walking motion such as between 30 centimeters behind the crutches to 20 centimeters ahead of the crutches. The predetermined release position may be adjusted by the individual user to match their normal range of motion by adjusting the seat urging means 150. For example, for the embodiments shown in FIGS. 3, 4A, 4B the elastic shock cord 162 may be shortened to increase the pull or lengthened to decrease the pull or the routing element 190 of FIGS. 3, 4A, 4B may be moved to a different position on the crutch 300 to alter the direction or amount of pull.

Also, the seat assembly 104 may disengage or release at a predetermined force. This force may be low enough to allow the seat assembly 104 to release easily when the user wants to separate himself from the crutches 300, for example a force in the range of one to twenty five Newtons, and preferably in the range of 2 to 20 Newtons, but high enough to urge the seat 100 close to the user during normal use.

In addition to providing convenience, the release system may also serve as an automatic safety release. For example, the system may release if the user loses his balance, or starts to fall, or begins to sit in a chair without remembering to first exit the seat 100 completely. This overcomes a limitation of the prior art that does not include an automatic release feature.

Figure 12:
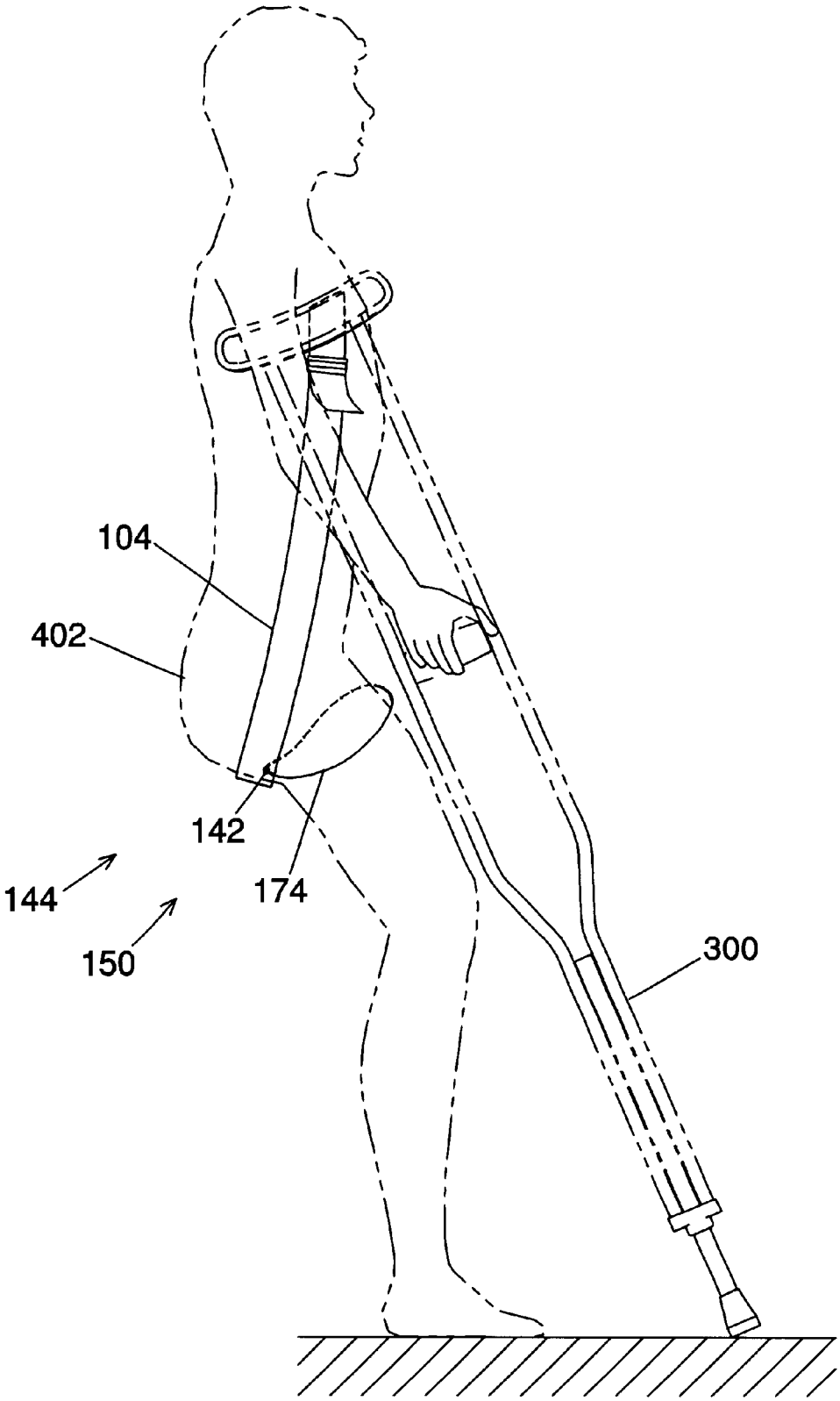
FIG. 12 is a side view of the support assembly with a cord from the seat assembly to the user's leg.

The attachment means 144 may releasably attach the seat urging means 150 from the seat assembly 104 to either the crutches 300, the user's clothing, or the user. The seat urging means 150 and the attachment means 144 may be combined. For example FIG. 12 shows the seat assembly 104 urged and releasably fastened to the user's leg with a cord 174 and hook and loop fastener 142, such that the seat assembly 104 automatically disconnects from the user when pulled harder than during normal crutch walking.

Figure 13:
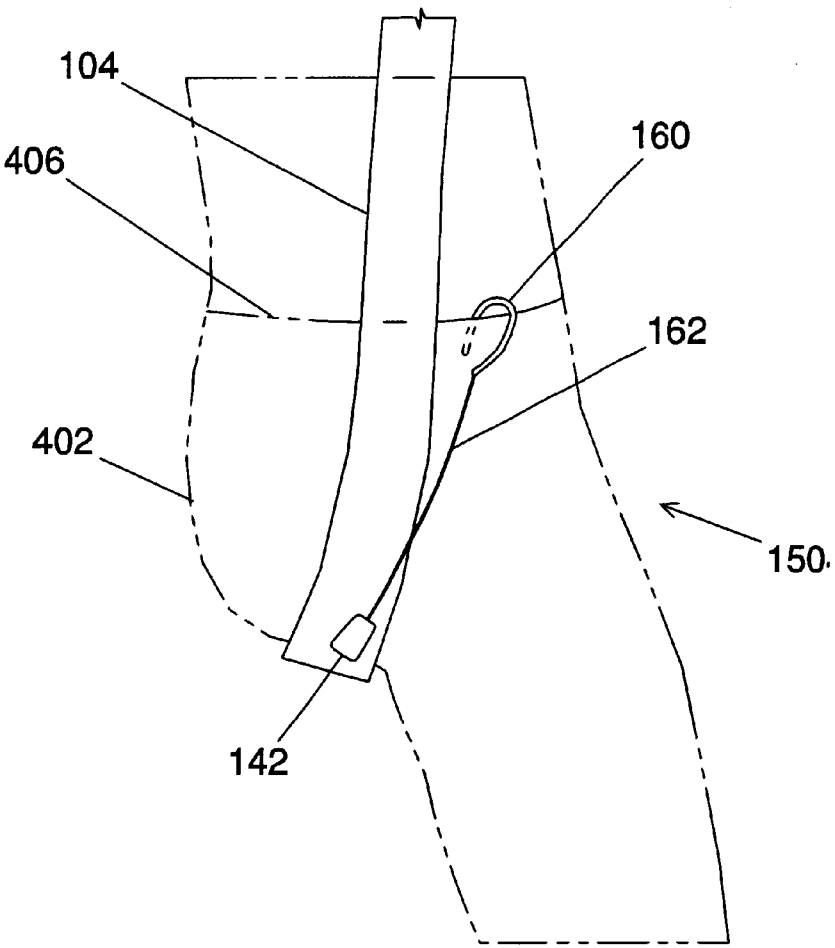
FIG. 13 is a detail side view of the support assembly with an elastic cord and hook from the seat assembly to the waist band on the user's clothes.

The seat assembly 104 may attach to the user's clothes at a waistband 406 with the hook and loop fastener 142, the elastic cord 150, and a hook 160 as shown in FIG. 13.

Figure 14:
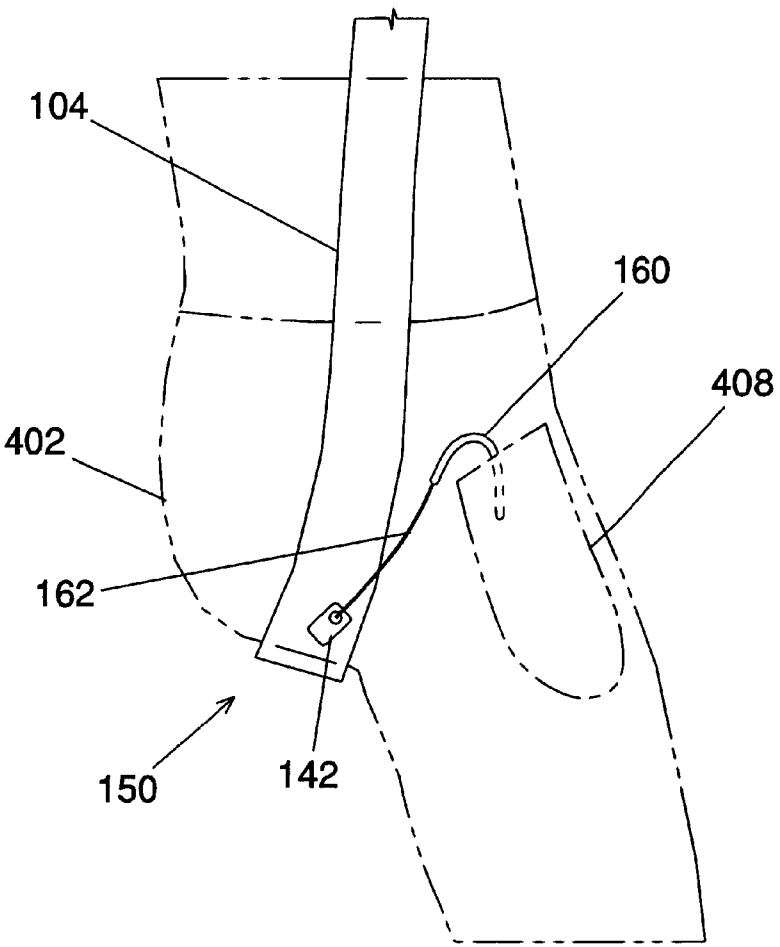
FIG. 14 is a detail side view of the support assembly with an elastic cord and hook from the seat assembly to the side pocket on the user's clothes.

The attachment means 144 may attach to the user's clothes in a pocket 408 with the hook and loop fastener 142, the elastic cord 150, and the hook 160 as shown in FIG. 14. The hook may be flexible so that it bends and releases at a predetermined force.

Figure 15:
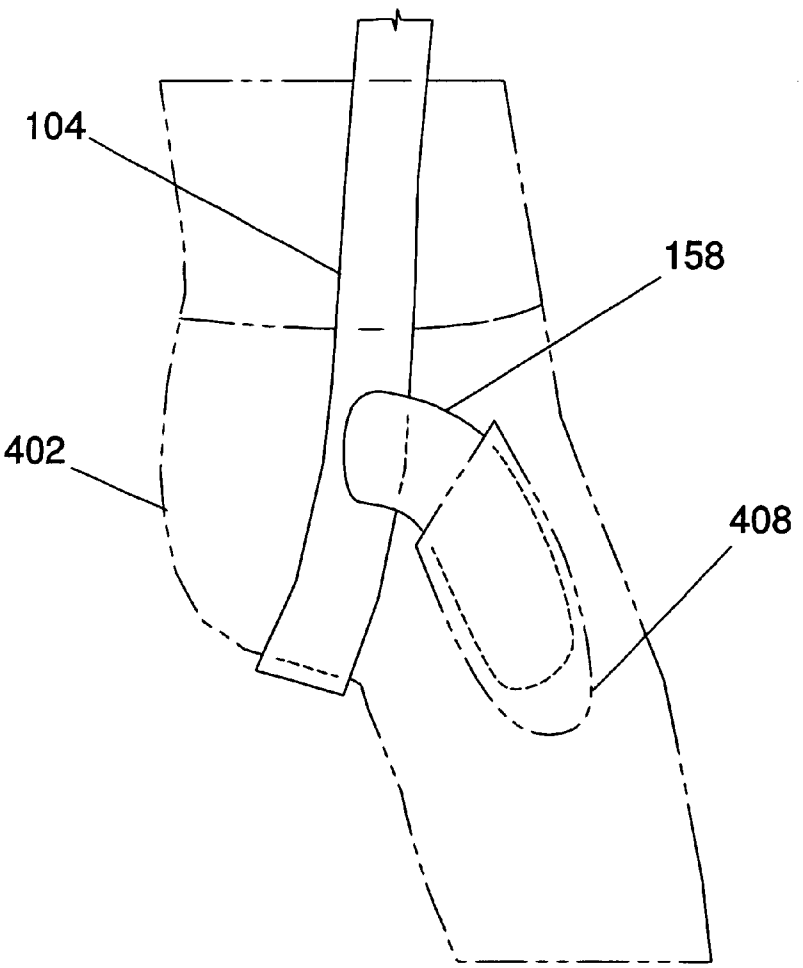
FIG. 15 is a detail side view of the support assembly with a pocket insert from the seat assembly to the side pocket on the user's clothes.
Figure 18:
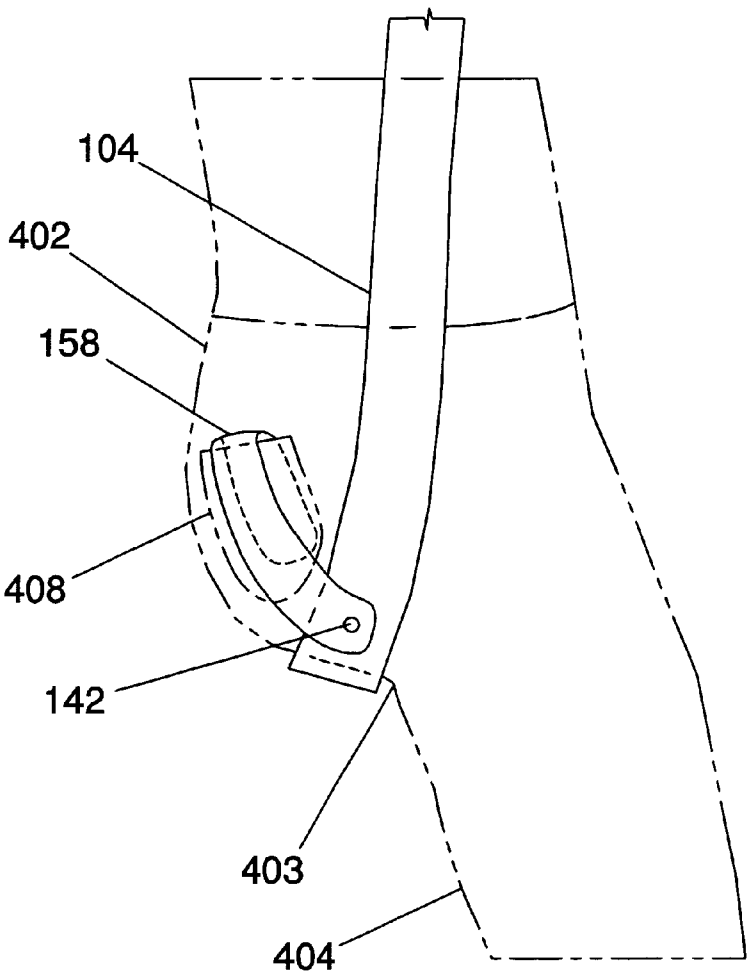
FIG. 18 is a detail side view of the support assembly with a pocket insert from the seat assembly to the rear pocket on the user's clothes.
Figure 17C:
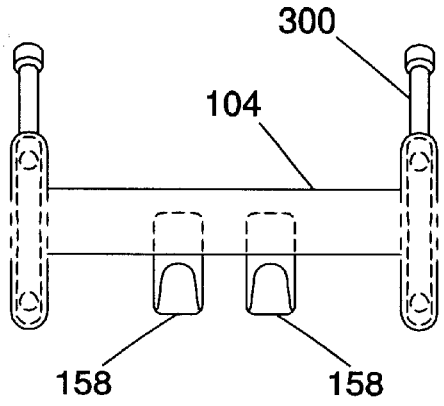
FIG. 17C is a top view of the support assembly of FIG. 17A with hooks from the seat assembly for the user's rear pants pocket.
Figure 17B:
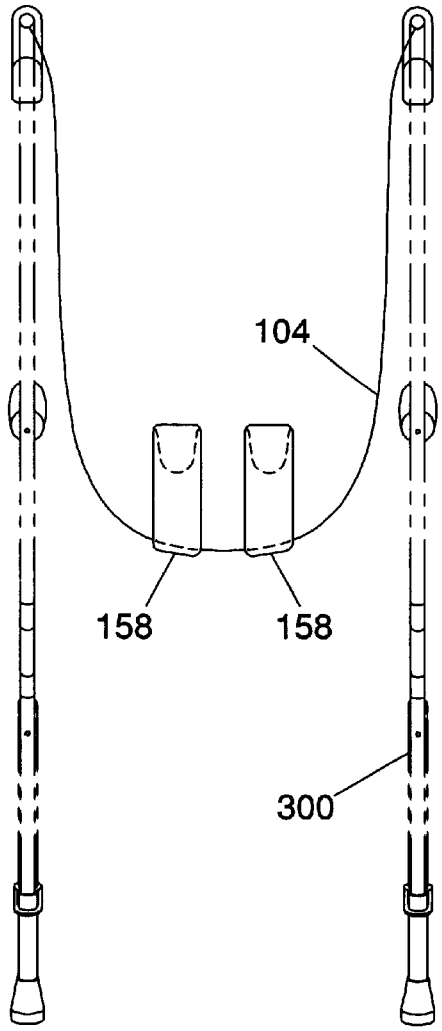
FIG. 17B is a rear view of the support assembly with hooks from the seat assembly for the user's rear pants pocket of FIG. 17A.
Figure 17A:
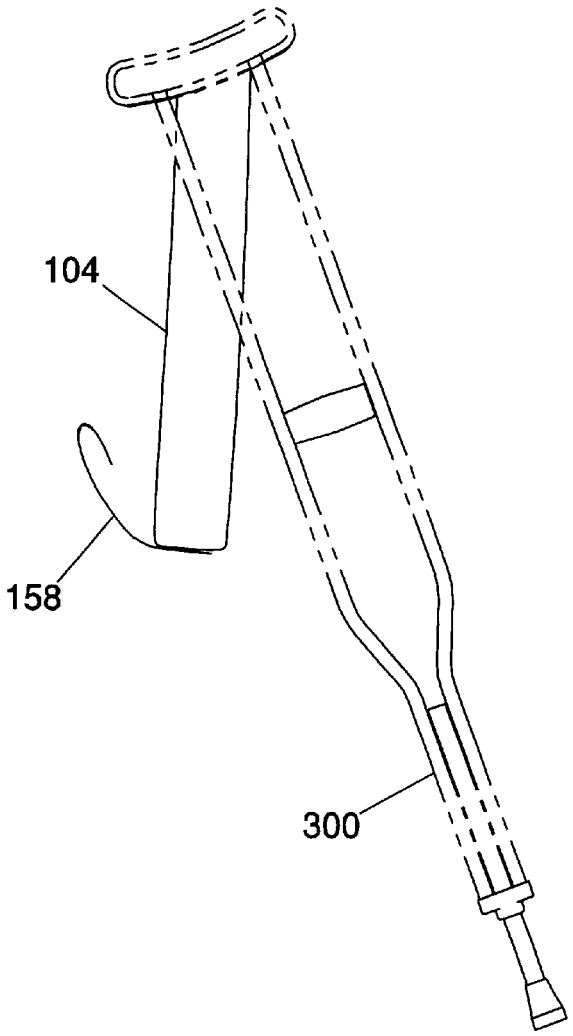
FIG. 17A is a side view of the support assembly with hooks from the seat assembly for the user's rear pants pocket, and crutches.

The attachment means 144 may attach to the user's clothes in a pocket 408 with a pocket insert 158 as shown in FIGS. 15, 17, 18. The pocket insert 158 may be flexible such that it bends and releases at a predetermined force.

Figure 16:
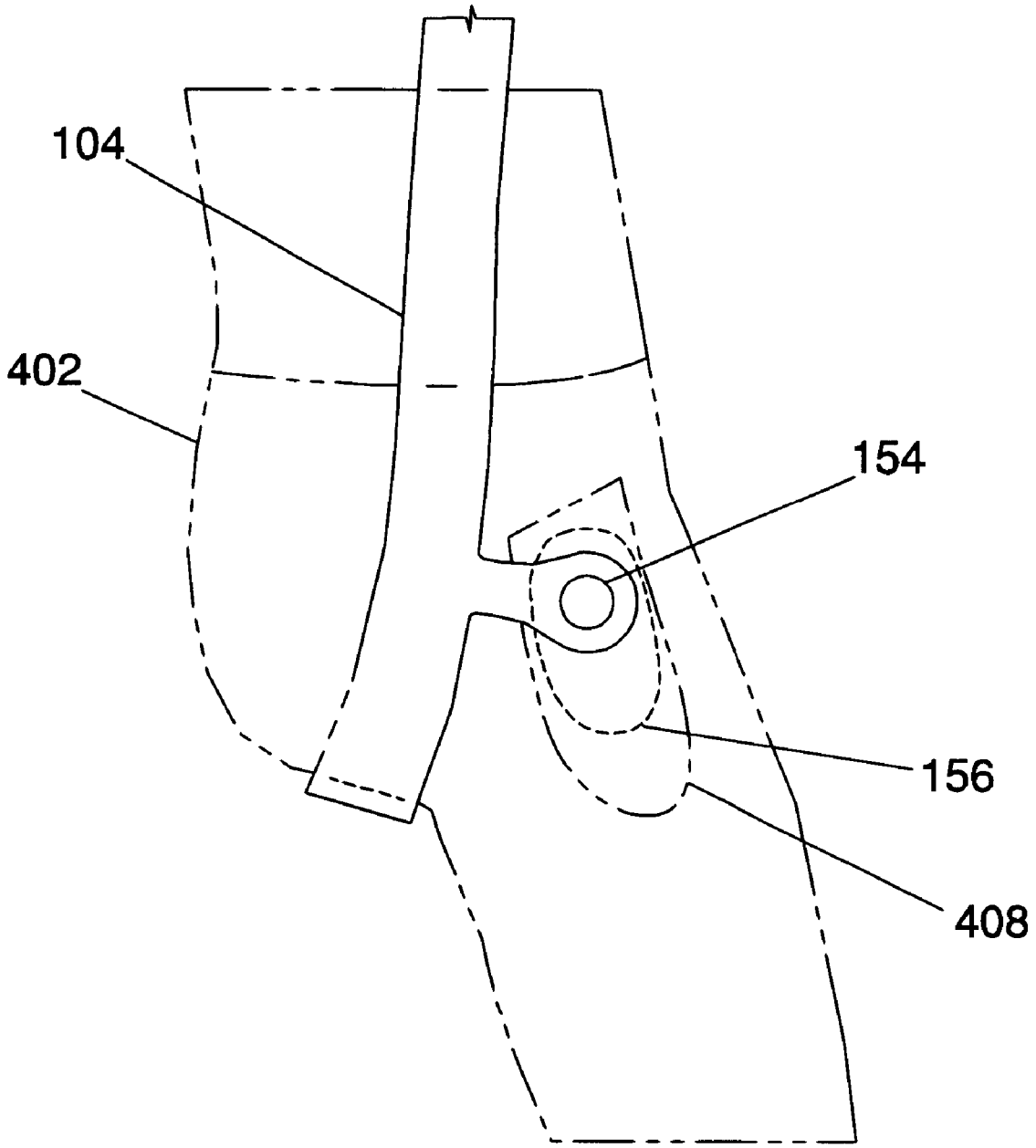
FIG. 16 is a detail side view of the support assembly with magnets from the seat assembly to the user's clothes.

At least one magnet 154 may attach directly or indirectly to the seat assembly 104 and magnetically attract another magnet or magnetically attractable object 156 attached to the user, on the user's clothes or in the user's clothes pocket as shown in FIG. 16. Example magnetically attractable objects include steel, or rubber impregnated with magnetic particles.

The user may wear a belt or garter or other clothing item that contains a fastener such as a hook and loop fastener or a magnet that connects to the seat urging means 150.

A hook and loop fastener may attach the seat urging means 150 to the crutch 300 and/or to the user.

Figure 20B:
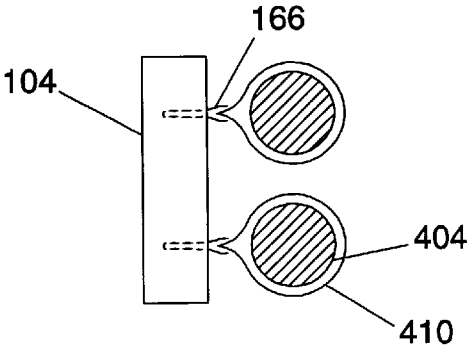
FIG. 20B is a detail top view of the support assembly with clips from the seat assembly to the user's clothes.
Figure 20A:
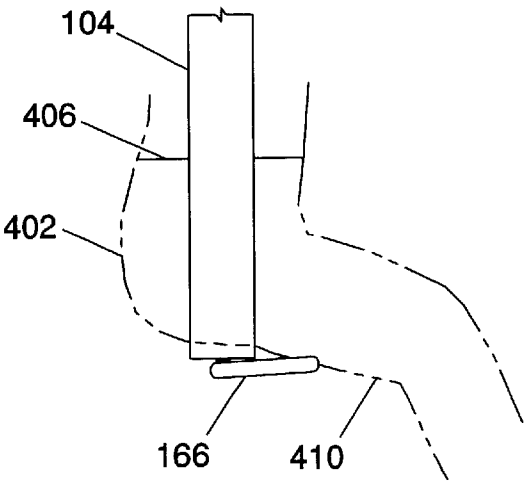
FIG. 20A is a detail side view of the support assembly with clips from the seat assembly to the user's clothes.

The attachment means 144 may attach to the user's clothes 410 with a clip 166 such as a clothes pin as shown in FIG. 20A, 20B.

Figure 22B:
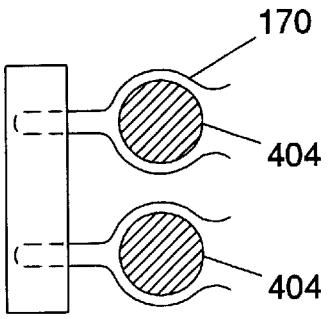
FIG. 22B is a detail top view of the support assembly with a retainer from the seat assembly to the user's legs.
Figure 22A:
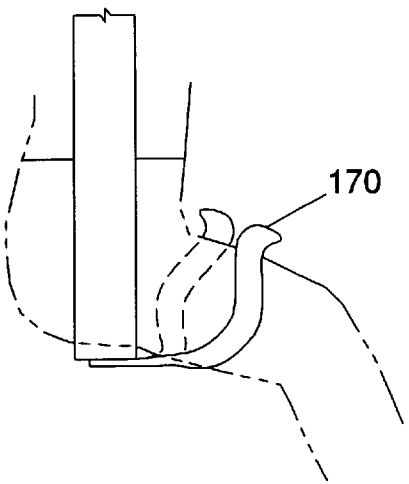
FIG. 22A is a detail side view of the support assembly with a retainer from the seat assembly to the user's legs.
Figure 21B:
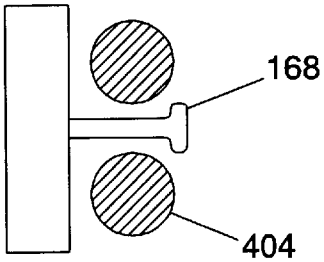
FIG. 21B is a detail top view of the support assembly with a retainer from the seat assembly to the area between the user's legs.
Figure 21A:
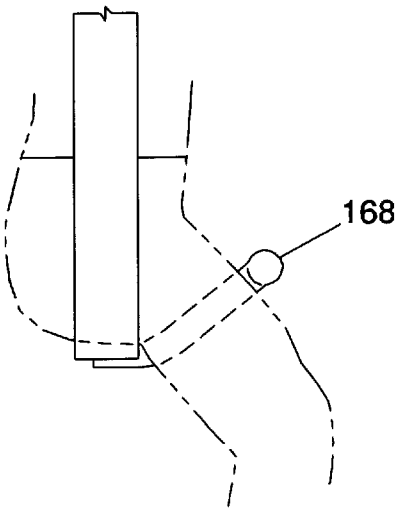
FIG. 21A is a detail side view of the support assembly with a retainer from the seat assembly to the area between the user's legs.

The attachment means 144 may attach to the user's leg 404 with a crotch retainer 168 as shown in FIG. 21A, 21B or a leg retainer 170 as shown in FIG. 22A, 22B. Other releasable fasteners include a buckle, a snap, or other attachment means 144.

In the preferred embodiment the seat urging means 150 includes an elastic cord 162 such as shock cord covered with nylon fabric braid or bungee cord or spring 172. One end of the cord 162 connects to the crutch 300. The other end of the cord may attach to the seat 100 or the suspension element 102 (FIG. 1). The cord 162 may be pretensioned (i.e. prestretched) so that it maintains its pull on the seat 100 during entry and exit by the user, or even without the user present on the seat 100. This stabilizes the seat 100 for easier entry and exit. For example, the pull from the seat urging means 150 may help hold the seat 100 in position as the user stands facing away from the seat 100 and places their butt 402 on the seat 100. The cord 162 is preferably longer than the minimum distance from the crutch 300 to the seat 100. A long cord (longer than 15 centimeters) has several advantages: it allows for a large range of motion of the crutches 300 relative to the seat 100; it reduces the variation in cord tension throughout the range of motion; it allows for a sufficient range of motion even when the cord 162 is pre-tensioned.

Figure 3:
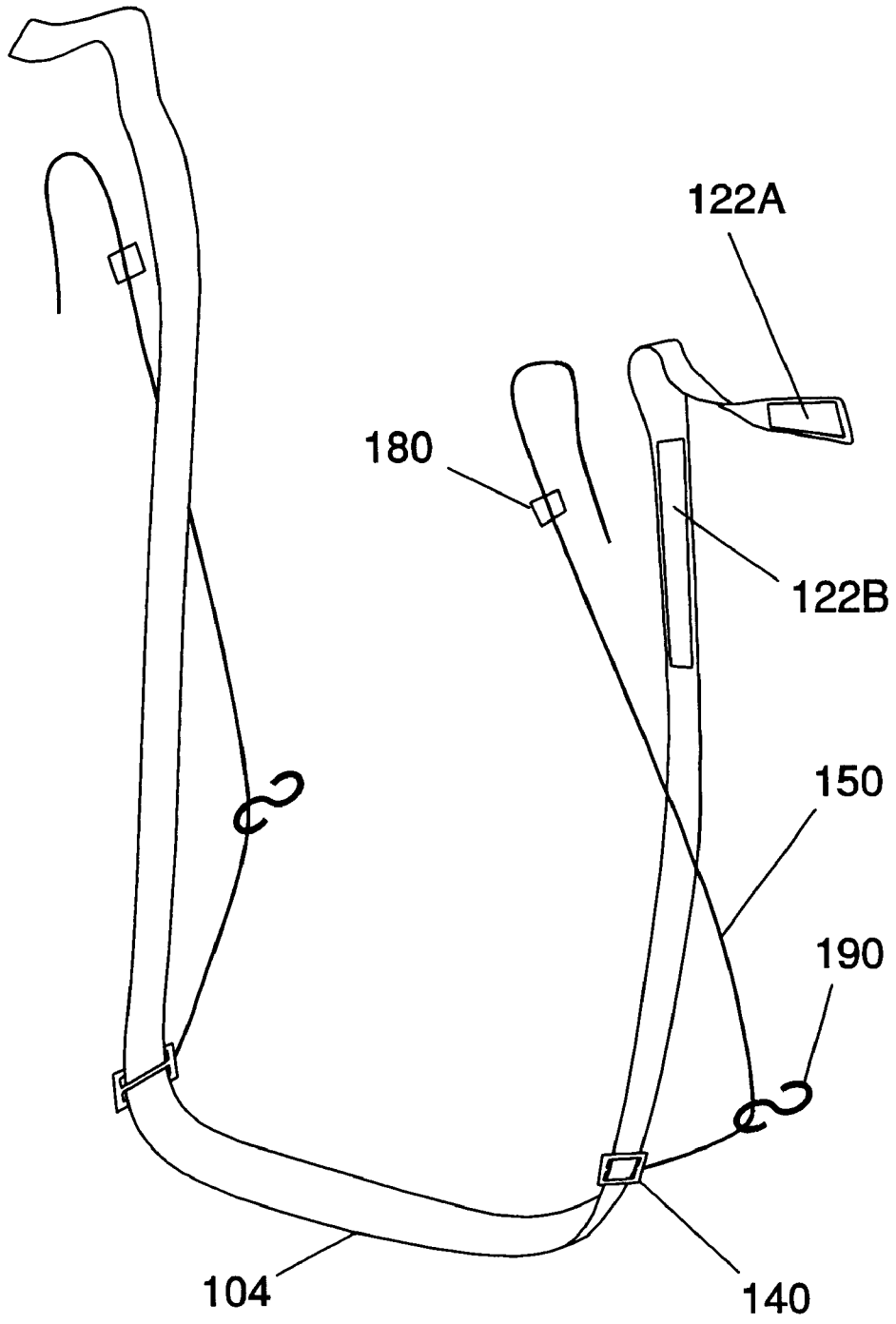
FIG. 3 is a perspective view of the support assembly for a crutch user.

The cord length may be adjusted to change the amount of pull or the amount of pre-tension. Cord length may be adjusted by a slidable fastener 180 such as a sliding cord lock for backpacking equipment as shown in FIG. 3 or by a knot.

The elastic cord diameter may be chosen to provide the desired force characteristics. In the preferred embodiment, the elastic cord 162 may be 1/16 inch to ½ inch diameter, and more preferably ⅛ inch to 5/16 inch diameter.

The cord attachments to the seat assembly 104 and to the crutch 300 may be moved to alter the location, direction, and amount of pull of the cords 162. The elastic cords 162 may attach to the seat assembly via slidable clips 140 as shown in FIG. 4. The cords 162 may releaseably attach to the seat or to the slidable clips or to the crutches, for example with a hook and loop fastener.

Figure 4A:
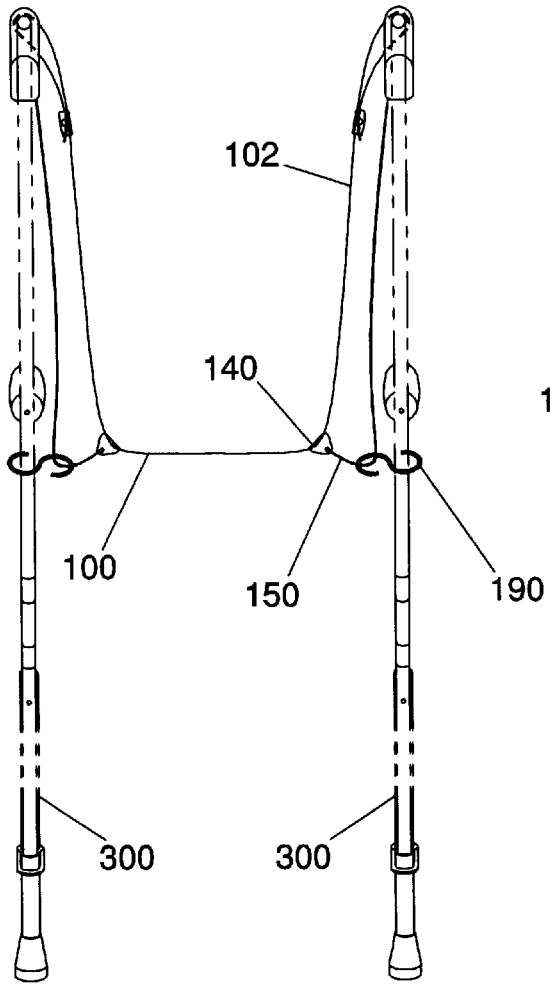
FIG. 4A is a rear view of the support assembly and crutches with a hook for routing the seat urging means.
Figure 4B:
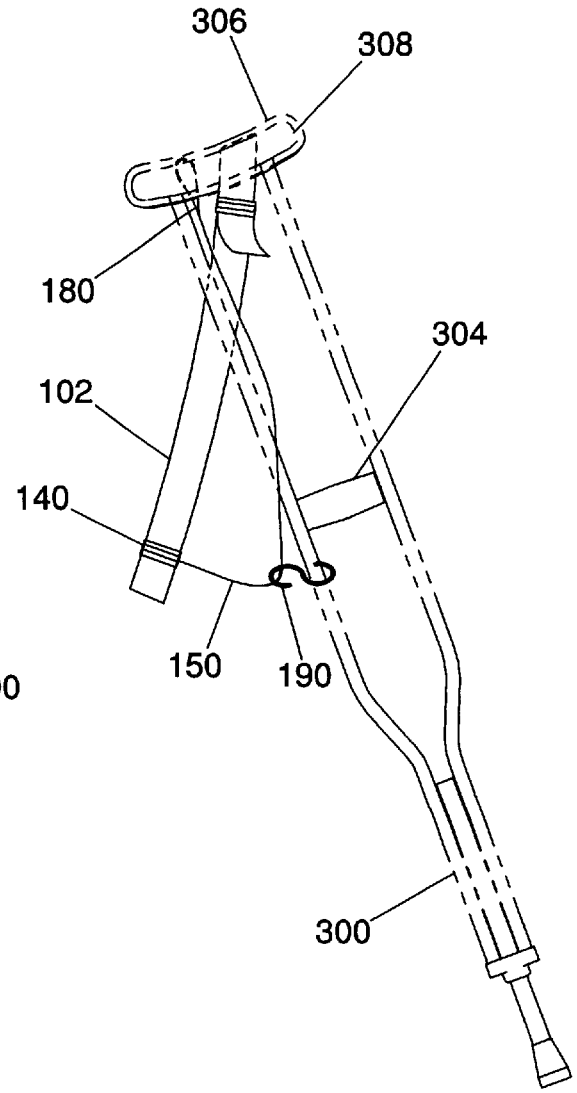
FIG. 4B is a side view of the support assembly and crutches with a hook for routing the seat urging means of FIG. 4A.
Figure 5:
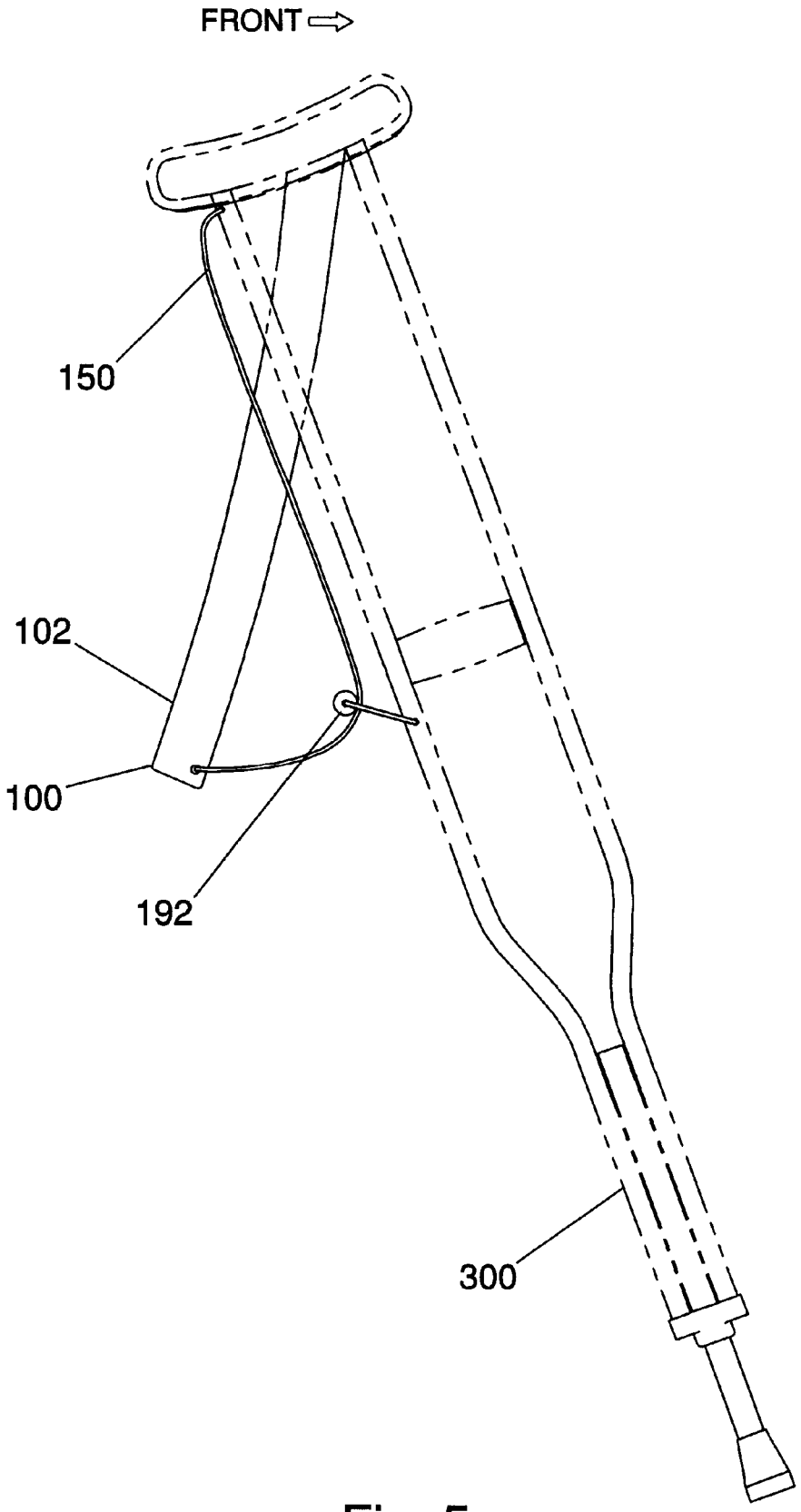
FIG. 5 is a side view of the support assembly and crutches with a pulley for routing the cord.
Figure 6A:
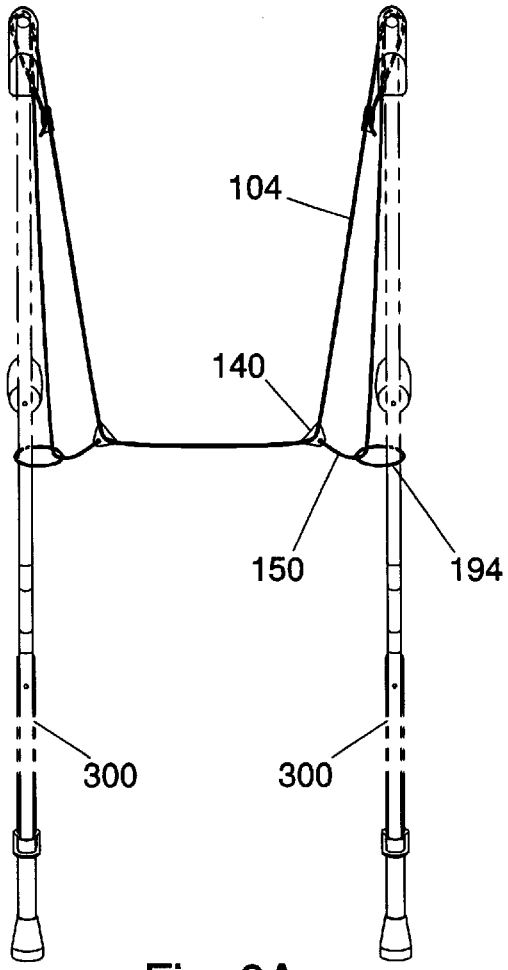
FIG. 6A is a rear view of the support assembly with a loop for routing the cord.
Figure 6B:
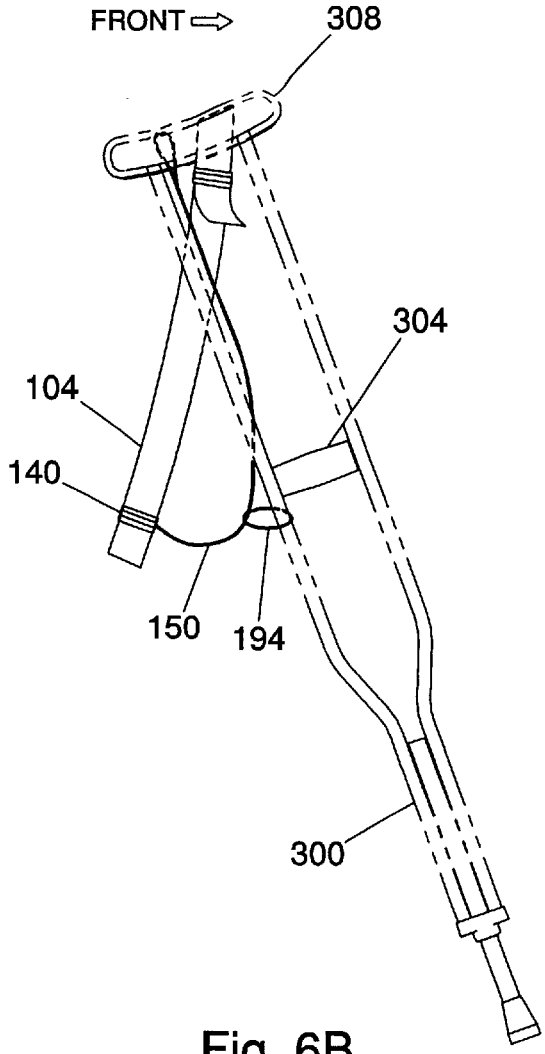
FIG. 6B is a side view of the seat assembly with a loop for routing the cord of FIG. 6A.
Figure 6C:
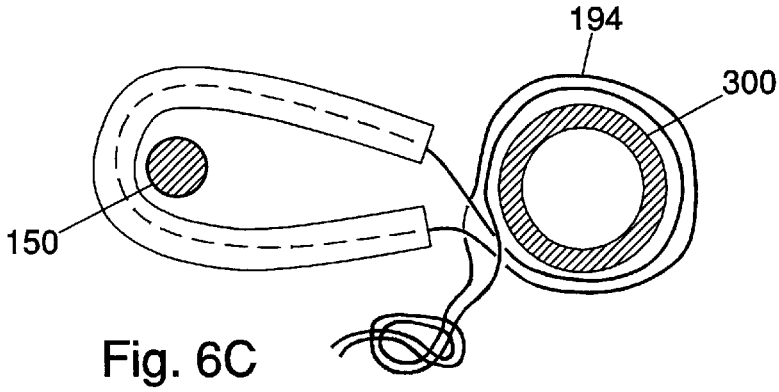
FIG. 6C is a detail top view of the loop for routing the cord of FIG. 6A.
Figure 10:
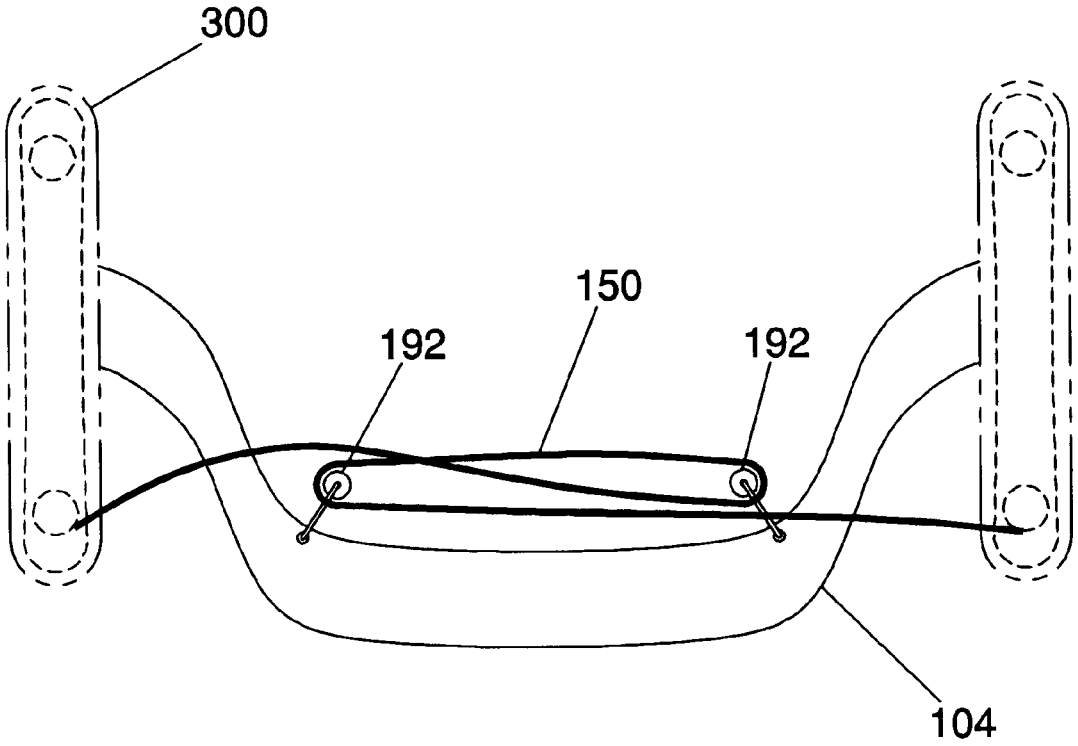
FIG. 10 is a top view of the support assembly with a cord from one crutch to the other routed through pulleys on the seat.

The cord 162 may be routed through at least one routing element to act as a support to change the direction of pull, to provide a smooth low friction surface for the cord 162 to slide across, and to help keep the cord 162 from tangling with other objects. This allows the elastic cord 162 to slide and stretch. An additional benefit of this design is that it facilitates the use of long lengths of elastic cord 162 thereby reducing the variation in elastic force during each crutch walking cycle. FIGS. 4A, 4B show an S hook routing element 190 such as size 8 plastic S hook by Plasti-Chain Company connected to the crutch 300 below the crutch handle 304. Other example rounting elements include a pulley 192 as shown in FIG. 10, loop 194 as shown in FIG. 6, sleeve 196 as shown in FIG. 9A and 9B, tube, or other routing means.

Figure 7:
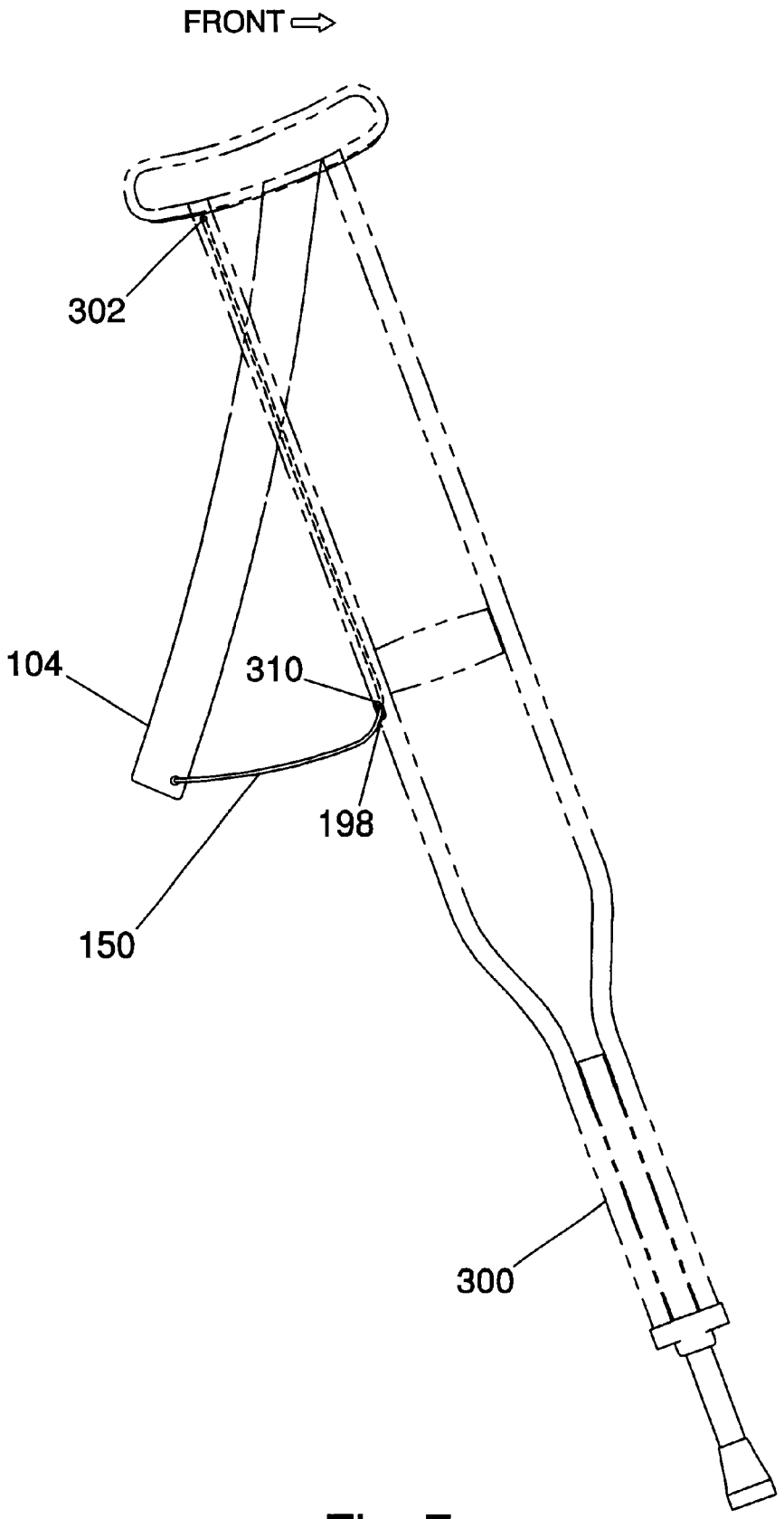
FIG. 7 is a side view of the support assembly with an elastic cord routed inside a hollow crutch.
Figure 8A:
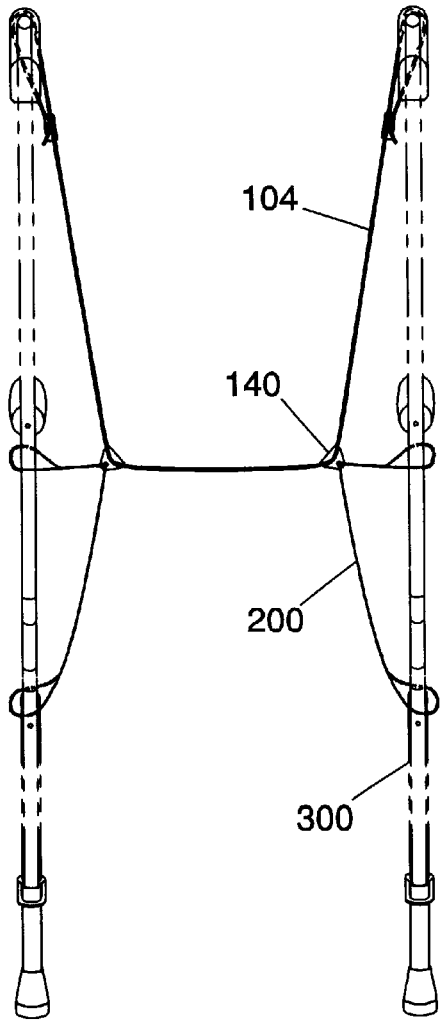
FIG. 8A is a rear view of the support assembly with a seat stabilizing means and crutches.
Figure 8B:
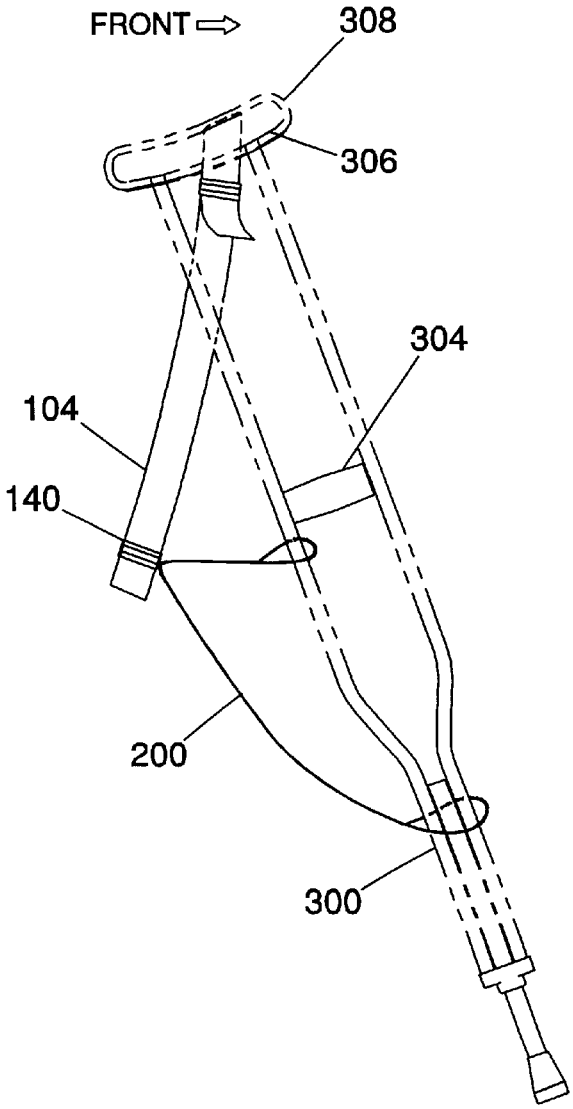
FIG. 8B is a side view of the support assembly with a seat stabilizing means and crutches.

The elastic cord 162 may be routed towards the top of the crutch 300 as shown in FIGS. 1, 2, 4, 5, 6 to keep the shock cord partially shielded by the crutch 300, the arms and the body. This reduces the chance of the elastic cord 162 catching on objects or on the user's legs and is preferred. The elastic cord 162 may be routed through the hollow section of a hollow crutch 302 and out a hole 310 as shown in FIG. 7. This may form a longer length of elastic and reduces the variation in elastic force during each crutch walking cycle. It also keeps part of the elastic cord 162 out of the way, and reduces the chance of it catching on objects. A bushing, grommet 198, or other protective means may be placed in the hole to protect the elastic cord 162 from the edge of the hole 310.

Figure 11A:
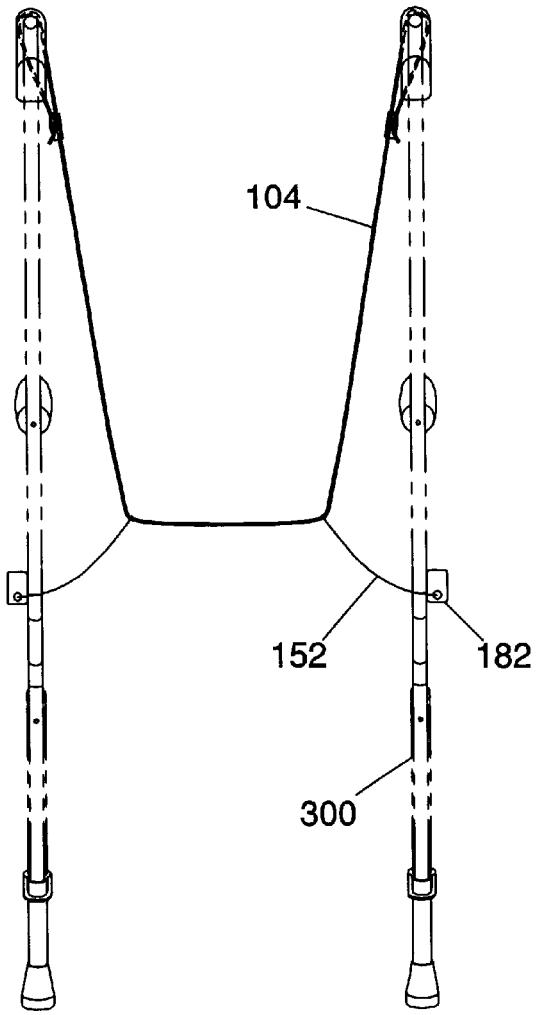
FIG. 11A is a rear view of the support assembly with a flexible line and take up reel mechanism.
Figure 11B:
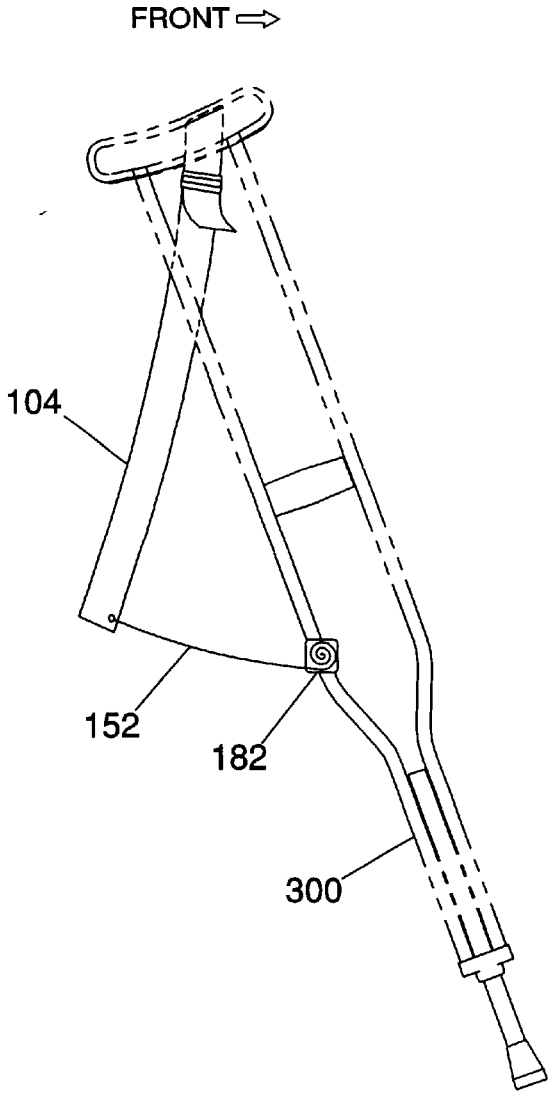
FIG. 11B is a side view of the support assembly with a flexible line and take up reel mechanism of FIG. 11A.

A flexible line 152 connected to a spring take up reel 182 may be used to pull the seat towards the user's butt as shown in FIG. 11. These springs pull with a relatively constant force versus elongation, similar to the mechanism used to automatically rewind a metal spring tape measure or a retractable dog leash such as a Flexi™ brand dog leash.

Figure 19:
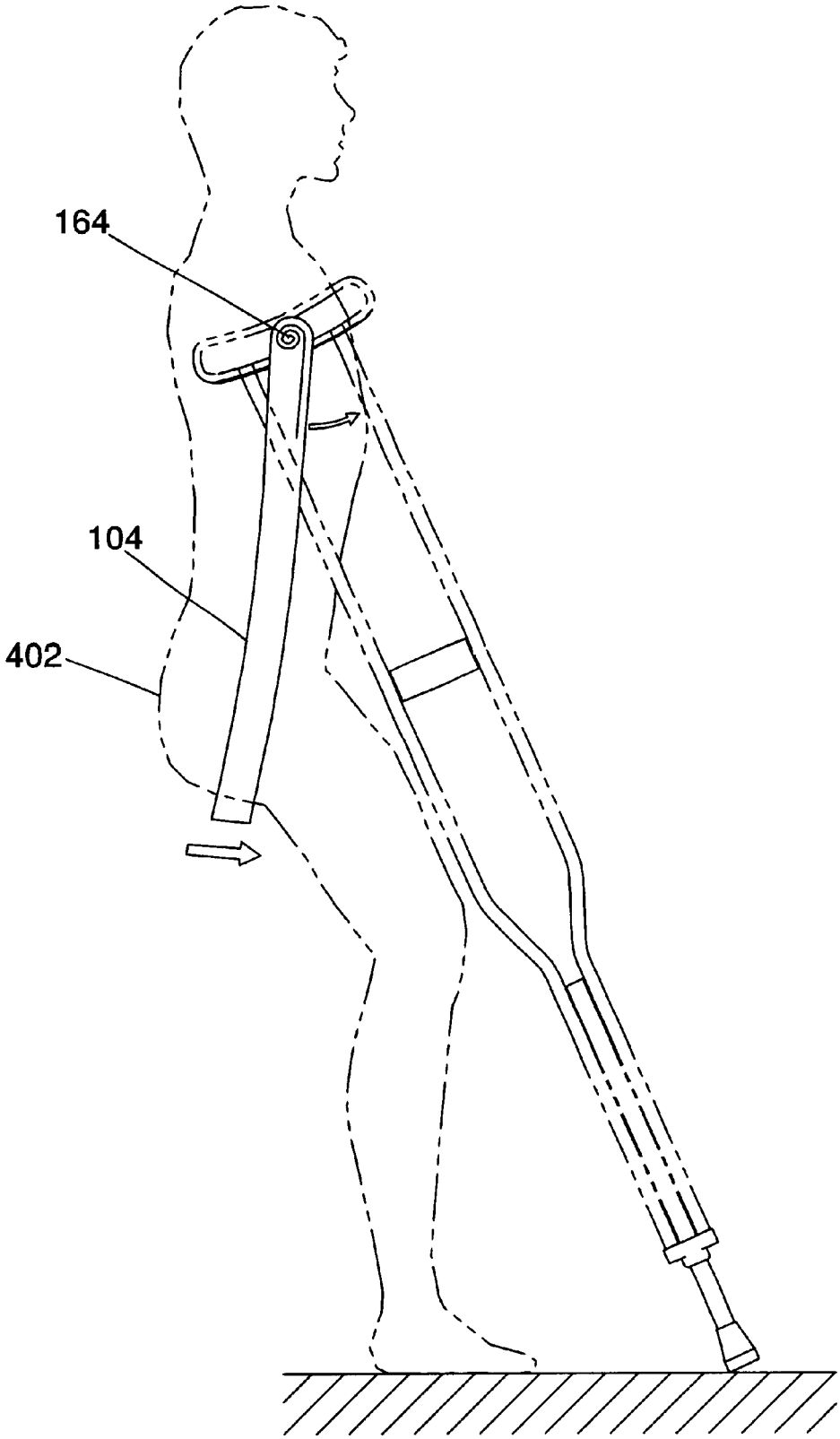
FIG. 19 is a side view of the support assembly with a torsion spring.

A torsion spring 164 or beam spring may rotate the seat assembly against the user's butt 402 or gluteal fold 403 or leg 404 as shown in FIG. 19. The suspension elements connected to the seat may be made stiff enough to transmit the torque from the spring to the section of the seat under the user's butt.

A seat stabilizing means 200 as shown in FIG. 8 may stabilize the seat 100 and suspension element 102 during entry and exit. The stabilizing means 200 may be used to pull the seat 100 or suspension element 102 into position near the crutches 300. This increases safety and convenience, and may be especially useful with a flexible seat. For example, the pull from the seat stabilizing means 200 helps hold the seat 100 in position as the user stands facing away from the seat 100 and places their butt on the seat 100. A flexible portion of the support system that is pulled taut close to the crutch 300 may be less likely to tangle in the user's clothing (such as an open jacket or sweater) during entry and exit from the seat 100. Example stabilizing means 200 include elastic cord or spring such as steel coil extension spring, superelastic nitinol coil extension spring. The seat stabilizing means 200 may be combined with the seat urging means 150.

The present invention is preferably collapsible for convenient transport while not in use.

While several particular forms of the invention have been illustrated and described, it will be apparent that various modifications can be made without departing from the spirit and scope of the invention. For example, the elements described in specific embodiments may be combined and permuted to form additional embodiments. References to materials of construction and specific dimensions are also not intended to be limiting in any manner and other materials and dimensions could be substituted and remain within the spirit and scope of the invention. Accordingly, it is not intended that the invention be limited, except as by the appended claims.

What is claimed is:

1. A support assembly for supporting at least part of a user's weight while the user is utilizing crutches, the support assembly comprising:

a seat assembly having a seat member and at least two suspension elements extending therefrom, and a flexible seat urging means for urging said seat member close to a users posterior, wherein said seat urging means is configured to automatically release the user from the crutches when a predetermined condition is met.

2. The support assembly of claim 1 wherein said urging means is adapted to automatically release the user when a predetermined force is exceeded.

3. The support assembly of claim 1 wherein said urging means is adapted to automatically release the user when the user's posterior has moved a predetermined distance from said seat member.

4. A support assembly according to claim 1 wherein the variation in force exerted by the seat urging means throughout the range of crutch walking motion is reduced by using a seat urging means including an element selected from the group consisting of an elastic member longer than 15 centimeters, a spring longer than 15 centimeters, and a constant force spring.

5. A support assembly according to claim 1 wherein said seat urging means is elastically extensible.

6. A support assembly according to claim 1 wherein said seat is slip resistant.

7. A support assembly according to claim 1 wherein said seat assembly is adjustably positioned.

8. A support assembly for supporting at least part of a user's weight while the user is utilizing crutches, the support assembly comprising:

a seat assembly having a seat member and at least two suspension elements extending therefrom, and a seat urging means for urging said seat member close to a users posterior, wherein said seat urging means is configured to automatically release the user from the crutches when a predetermined condition is met, said seat urging means including a releasable attachment for connecting said seat assembly to one selected from the group consisting of crutches, a user's clothing, and the user.

9. A support assembly for supporting at least part of a user's weight while the user is utilizing crutches, the support assembly comprising:

a seat assembly having a seat member and at least two suspension elements extending therefrom, and a seat urging means for urging said seat member close to a users posterior, wherein said seat urging means is configured to automatically release the user from the crutches when a predetermined condition is met, wherein said seat member and said at least two suspension elements are integrally formed in a single flexible strap.

10. A support assembly for supporting at least part of a user's weight while the user is utilizing crutches, the support assembly comprising:

a seat assembly having a seat member and at least two suspension elements extending therefrom, said seat member having at least one folding section, a seat urging means for urging said seat member close to a users posterior, wherein said seat urging means is configured to automatically release the user from the crutches when a predetermined condition is met.

11. A support assembly for supporting at least part of a user's weight while the user is utilizing crutches, the support assembly comprising:

a seat assembly having a seat member and at least two suspension elements extending therefrom, and a seat urging means for urging said seat member close to a users posterior, wherein said seat urging means is configured to automatically release the user from the crutches when a predetermined condition is met, the seat urging means being adjustable for a characteristic selected from a group consisting of a location of pull, a direction of pull, and an amount of pull.

12. A support assembly for supporting at least part of a user's body weight while the user is utilizing crutches, the support assembly comprising: a seat assembly formed from a single strap, said seat assembly having a seat member and at least two suspension elements extending therefrom, an attachment means for attaching said at least two suspension elements to an upper portion of a pair of crutches, a cord holder attachable to one of the pair of crutches, a sliding clip attached to said seat assembly, an elastomeric cord attached to said seat assembly by said sliding clip and attachable to one of the pair of crutches, said elastomeric cord passing through at least a portion of said cord holder.

13. A support assembly for supporting at least part of a user's weight while the user is utilizing crutches the support assembly comprising:

a seat assembly having a seat member and at least two suspension elements extending therefrom, a seat urging means for urging said seat member close to a users posterior, wherein said seat urging means is configured to automatically release the user from the crutches when a predetermined condition is met, and graduated markings on an object selected from the group consisting of the suspension element, and the seat, wherein said graduated markings serve as a reference for adjusting the seat assembly position.

14. A support assembly for supporting at least part of a user's weight while the user is utilizing crutches, the support assembly comprising:

a seat assembly having a seat member and at least two suspension elements extending therefrom, a seat urging means for urging said seat member close to a users posterior, wherein said seat urging means is configured to automatically release the user from the crutches when a predetermined condition is met, and an attachment means for releasably attaching said seat urging means from said seat assembly to an object selected from the group consisting of the users clothing and the user.

15. A support assembly according to claim 14 wherein said attachment means includes a hook and loop fastener.

16. A support assembly according to claim 14 wherein said attachment means utilizes magnetic attraction.

17. A support assembly for supporting at least part of a user's weight while the user is utilizing crutches, the support assembly comprising:

a pair of crutches, a seat assembly having a seat member and at least two suspension elements extending therefrom, said seat assembly having graduated markings on said crutches, wherein said graduated markings serve as a reference for adjusting the seat assembly position, and a seat urging means for urging said seat member close to a users posterior, wherein said seat urging means is configured to automatically release the user from said crutches when a predetermined condition is met.

18. A support assembly for supporting at least part of a user's weight while the user is utilizing crutches, the support assembly comprising:

a pair of crutches, a seat assembly having a seat member and at least two suspension elements extending therefrom, a seat urging means for urging said seat member close to a users posterior, wherein said seat urging means is configured to automatically release the user from said crutches when a predetermined condition is met, and an attachment means for releasably attaching said seat urging means from said seat assembly to said crutches.

* * * * *